United States Patent [19]

Rebel et al.

[11] 4,217,824

[45] Aug. 19, 1980

[54] DETACHABLE GAP COVERING ON CYLINDERS OF PRINTING PRESSES

[75] Inventors: Herbert Rebel, Rodgau; Claus Simeth, Offenbach am Main, both of Fed. Rep. of Germany

[73] Assignee: M.A.N.-Roland Druckmaschinen Aktiengesellschaft, Fed. Rep. of Germany

[21] Appl. No.: 8,099

[22] Filed: Jan. 31, 1979

[30] Foreign Application Priority Data

Feb. 3, 1978 [DE] Fed. Rep. of Germany ..... 2804556

[51] Int. Cl.[3] ..... B41F 27/06; B41F 13/42

[52] U.S. Cl. ..... 101/375; 101/216; 101/415.1

[58] Field of Search ..... 101/415.1, 378, 212–216, 101/375, 376, 409–412; 346/138; 358/291

[56] References Cited

U.S. PATENT DOCUMENTS

| | | | |
|---|---|---|---|
| 2,366,930 | 1/1945 | Pirie | 101/415.1 |
| 4,014,260 | 3/1977 | Schroter-Dommes | 101/415.1 |

FOREIGN PATENT DOCUMENTS

| | | | |
|---|---|---|---|
| 2520920 | 11/1976 | Fed. Rep. of Germany | 101/415.1 |

*Primary Examiner*—J. Reed Fisher

*Attorney, Agent, or Firm*—Leydig, Voit, Osann, Mayer & Holt, Ltd.

[57] ABSTRACT

A gap cover of arcuate cross section for covering the longitudinal channel in the cylinder of a printing press, the cover being dimensioned to bridge the gap and held in place by first and second fastening assemblies accommodated below the presented surface. The first fastening assembly includes an axially oriented hook and stirrup, while the second assembly includes a radially oriented shaft having a flat head of oblong profile forming a pair of wings. The cover has a recessed portion radially aligned with the latching element and containing an aperture of mating oblong profile bounded by land surfaces so that the head of the latching element may project therethrough, for locking engagement with the lands upon rotation through 90° by a turning tool. The shaft of the latching element has an associated detent for snapping the head from its free position to its locking position and for securely holding it there until intentionally released by additional turning movement. Preferably the cover has a nominal radius of curvature which is smaller that the radius of the cylinder, and the fastening assemblies are located at a radius which requires manual pressing of the cover into a slightly flattened sprung position as a precondition to engagement.

4 Claims, 8 Drawing Figures

DETACHABLE GAP COVERING ON CYLINDERS OF PRINTING PRESSES

The cylinders of a printing press are normally channeled; for example in a lithograph press a channel is provided in the plate cylinder for the clamping bars, grippers and shafts necessary for tensioning the plate. In the associated blanket and impression cylinders, channels serve to accommodate similar hardware employed for gripping and tensioning of suitable blankets. The gaps formed by such channels offer potential for severe injury of an operator because of their substantial width and the fact that they are invisible when the press is operated at speed.

Efforts have been made in the past to decrease this hazard by providing gap covers dimensioned to bridge the gap and which present a curved surface which is substantially flush with that of the cylinder, an example of such a detachable cover being shown in German disclosure specification DE-OS No. 2,520,920. The structures proposed in this patent and in similar patents are relatively complex both in their fabrication and in their provisions for mounting on the cylinder.

It is, accordingly, an object of the present invention to provide a gap cover for the cylinder of a printing press which is simple and economical, yet highly effective in providing protection and safety. It is a related object to provide a gap cover assembly which requires minimum modification of existing designs of cylinders, utilizing a supporting bar which occupies normally unused space and centered in the channel between the clamping assemblies which engage the respective ends of the plate or blanket. Consequently it is an object to provide a gap cover assembly which may be employed universally on all the cylinders of a lithograph printing press, including presses of new design and presses already in the field for the purpose of improving the safety rating thereof.

It is another object to provide a gap cover which is securely and positively retained on the cylinder in the face of the high rotative speeds achieved in modern presses. It is a related object to provide a gap cover which is sturdy and effective but which nevertheless is of light construction minimizing any tendency to unbalance the cylinder upon which it is mounted.

It is another object to provide a gap cover which is quickly and easily installed and removed, with a minimum of nuisance, encouraging consistent and conscientious usage by the pressman.

It is yet another object to provide a gap cover which does not present a hazard to the press itself by reason of incomplete or inadequate securement due to operator carelessness but which provides obvious visual and tactile indication that the cover is securely locked in place.

It is one of the more detailed objects of the present invention to provide a cover in which securement is in the form of simple but natural steps involving (a) short endwise movement of the cover into an axially registered position, (b) inward pressing of the cover for registered reception of a latching member, and finally, (c) detented rotation of the latching member through a right angle, with the procedure being simply reversed when removal is desired.

Finally it is an object of the present invention to provide a gap cover of arcuate shape which is manually "sprung" incident to installation by slight flattening movement so that the leading and trailing edges of the cover resiliently bear against land surfaces on the cylinder, plate, or blanket maintaining resilient contact thereagainst during operation to insure that the cover fits snugly and acts quietly, free of vibration or rattling, at all operating speeds.

Other objects and advantages of the invention will become apparent upon reading the attached detailed description and upon reference to the drawings in which.

Figure 3:
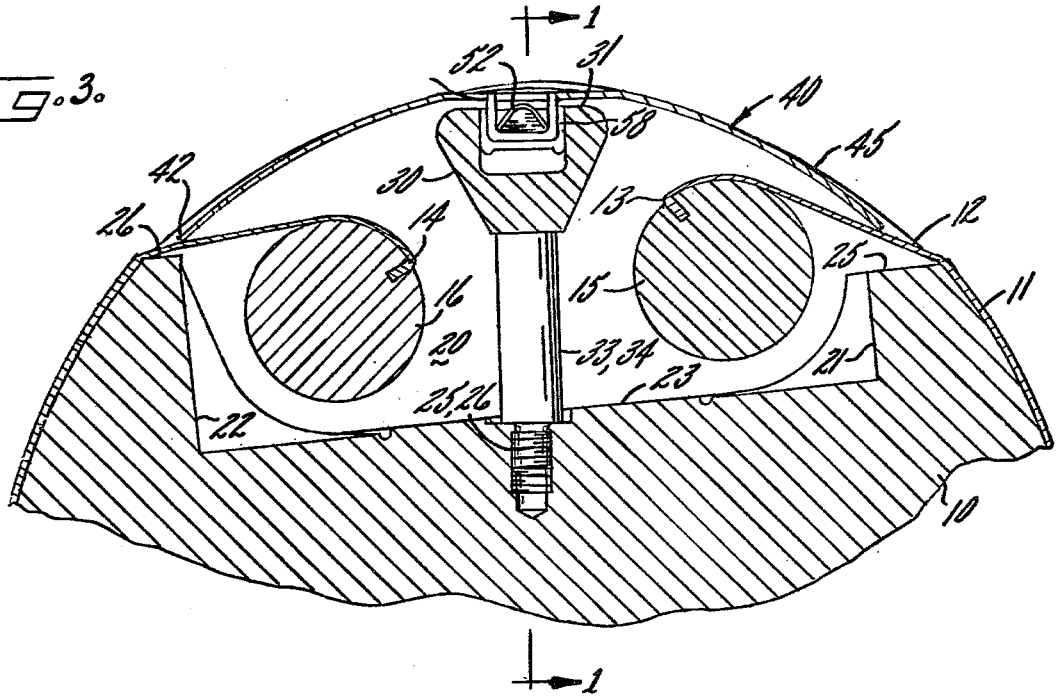
FIG. 3 is a transverse section taken along the line 3—3 in FIG. 1.
Figure 6:
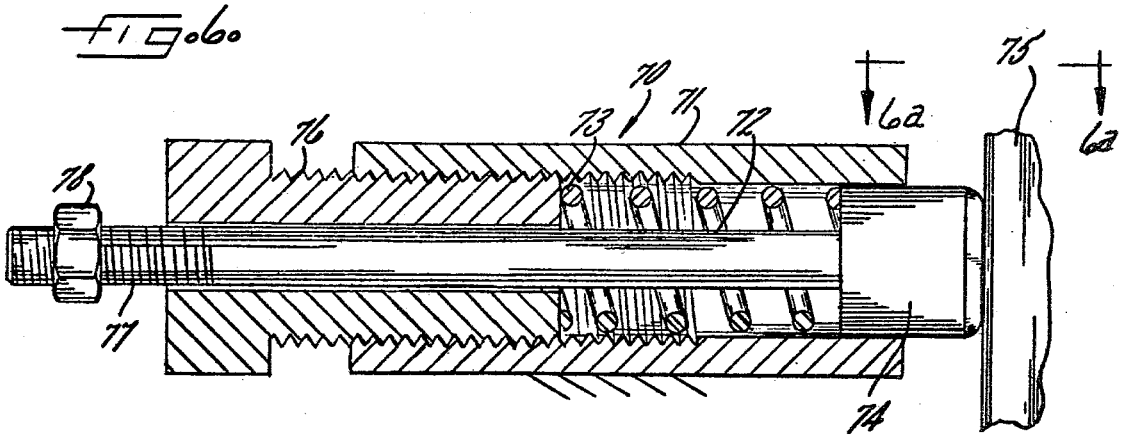
FIG. 6 is an enlarged longitudinal section taken through the detent mechanism shown in FIG. 1.
Figure 6A:
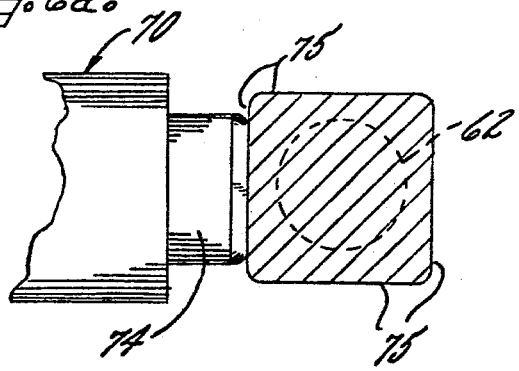
Figure 7:
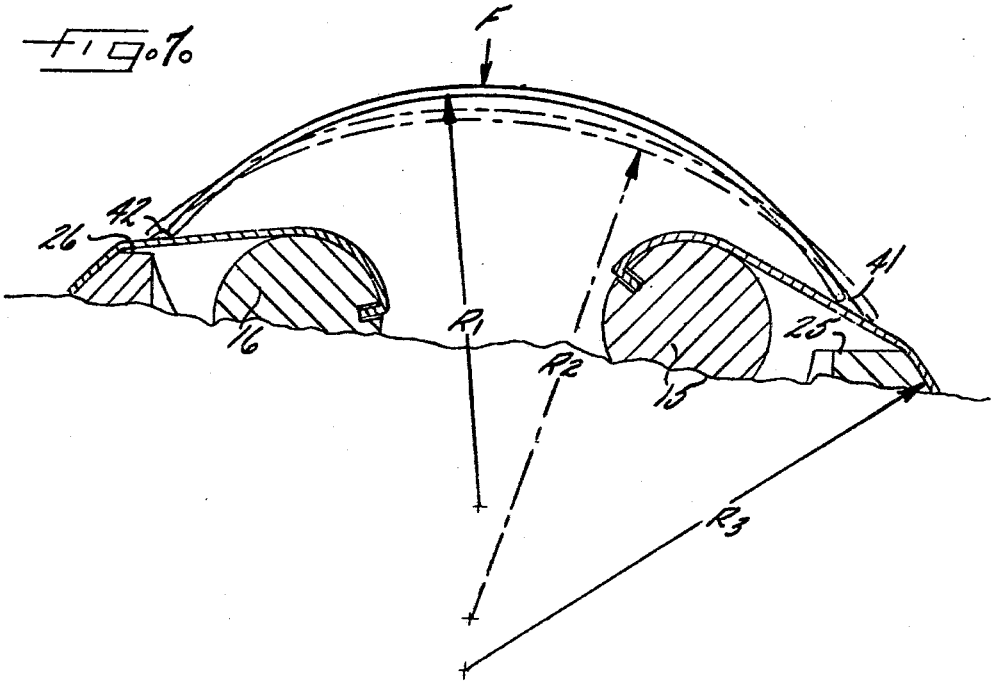

FIG. 6*a* is a fragmentary section looking along the line 6*a*—6*a* in FIG. 6;

FIG. 7 is a diagram similar to FIG. 3 showing the curvature of the gap cover in its relaxed state.

While the invention has been described in connection with a preferred embodiment, it will be understood that we do not intend to be limited by the particular embodiment shown but intend, on the contrary, to cover the various alternative and equivalent constructions included within the spirit and scope of the appended claims.

Turning now to the drawings, there is disclosed a cylinder 10 of a lithograph press, which cylinder may, for example, be a plate cylinder having an outer surface 11 upon which is mounted a flexible printing plate 12 having ends 13, 14, respectively. The ends of the plate are clamped and tensioned by engaging them with respective shafts 15, 16 having individual turning and positioning means which will be understood to be conventional and hence not shown. The shafts 15, 16 are arranged in spaced positions in a longitudinally extending channel 20 having side walls 21, 22 which extend parallel to one another the length of the cylinder with a flat floor surface 23 extending between them. The channel forms a "gap" in the cylindrical surface which is bounded by longitudinally extending "land" surfaces 25, 26, respectively.

In accordance with the present invention, a gap cover is provided for bridging the gap, the cover being made of a unitary sheet of thin material formed into arcuate cross section to present an outer surface which is substantially flush with the surface of the cylinder. The cover is dimensioned for minor overlap, with its lateral edges extending to the land surfaces along the lateral edges of the gap, thereby preventing the operator's hand from being injured if it should accidentally come in contact with the cylinder while the cylinder is rotating.

More specifically in accordance with the invention, first and second fastening assemblies are provided which are accommodated below the presented surface of the cover and axially spaced along the center of the gap with the first assembly including an axially oriented hook and cooperating stirrup and the second assembly including a radially oriented shaft having a flat head of oblong profile forming a pair of wings. The cover has a recessed portion radially aligned with the latching element and containing an aperture of mating oblong profile laterally bounded by land surfaces so that, when the cover is in axial register with the cylinder and the head is in rotational register with the aperture, the head of the latching element projects through the aperture into the recess. There the head is turned by a suitable turning tool substantially 90° so that the head moves from its rotationally registered free position to a locking position in which the wings of the head overlie the land surfaces, thereby locking the cover in place. The shaft of the latching element has an associated detent so that the head is snapped from its free position to its locking position, the detent serving to hold the latching element in place until it is intentionally released upon application of additional turning movement.

In accordance with one of the aspects of the present invention, the two fastening assemblies are mounted upon a supporting bar 30 which extends centrally down the channel 20 in an elevated position. The bar has a radially presented surface 31 which performs a stop or locating function, as will be described. The bar is of relatively limited cross section and occupies the space between the shafts 15, 16 which is not normally utilized. The bar is supported upon two or more spaced pedestals 33, 34 which are anchored by means of respective studs 35, 36 to the floor of the channel. The bar is secured to the tops of the pedestals by means of recessed machine screws 37, 38.

Extending parallel to the upper surface 31 of the bar and slightly spaced from it is a gap cover 40 having leading and trailing edges 41, 42, end edges 43, 44 and a presented arcuate outer surface 45 which, as shown in FIG. 3, is, in its installed condition, substantially flush with the surface 11 of the cylinder, although preferably slightly recessed with respect thereto. The gap cover 40 is of thin, light construction and preferably made of a low density material such as a light aluminum alloy or glass-fiber-reinforced plastic.

For securing the gap cover to one end of the bar (the left-hand end as viewed in FIGS. 1 and 2), a first fastening assembly 50 is used including an axially oriented hook 51 having a slightly pointed, upwardly bent tip 52 and a base or anchoring portion 53 which is secured to the bar by means of a pair of machine screws 54. A spacer 55 is interposed between the bar and the hook to provide a stop surface 56. Engaging the hook is a stirrup 57 of "U" shape, with the vertical legs 58 thereof being durably secured to the underside of the cover. The entire fastening assembly 50 is accommodated below the presented surface of the cover, preferably occupying a recess 59 formed in the upper surface of the bar 30.

It will be apparent that when the tip of the hook is registeringly engaged, and the cover is shifted axially, the hook moves relatively into seated position until the stop surface 56 is seated against the stirrup 57 which brings the cover into axial register with the cylinder.

Figure 1:
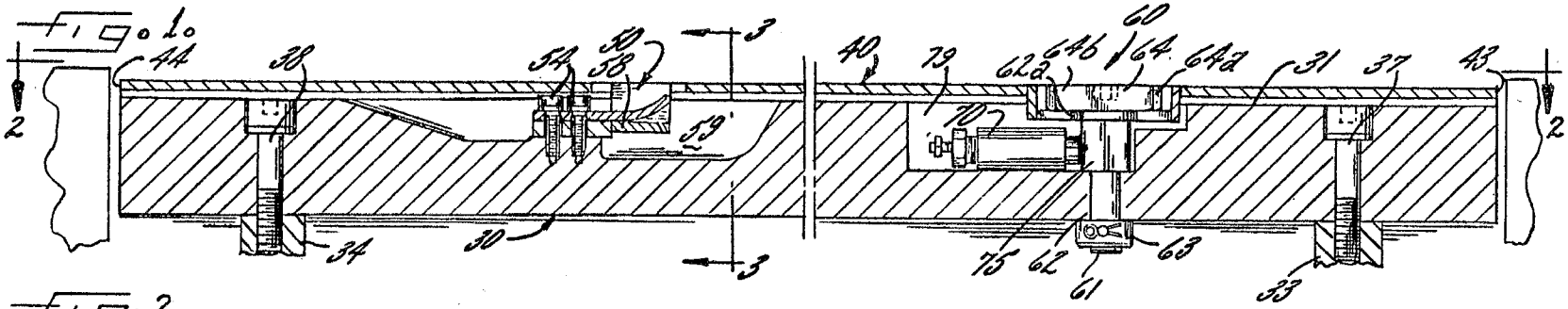
FIG. 1 shows an axial section of a gap cover assembly constructed in accordance with the invention, taken along the line 1—1 of FIG. 3, with the mechanism in unlocked condition.
Figure 5:
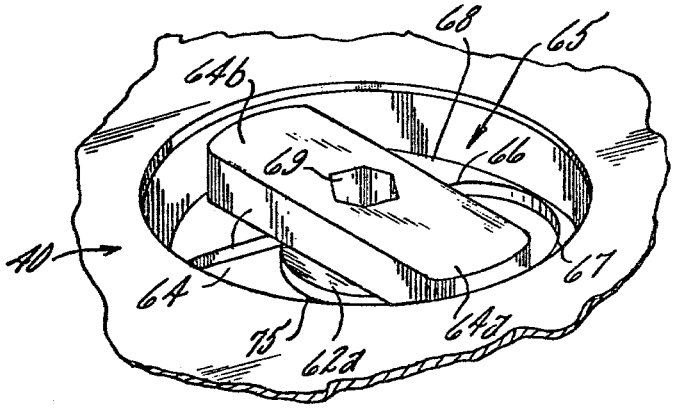
FIG. 5 is a fragmentary perspective showing the second fastening assembly in locked condition.

At the other end of the bar 30 is a second fastening assembly 60 (see especially FIG. 1). Such assembly includes a rotatable latching element 61 having a radially oriented shank 62 which is journalled in the bar 30 and kept captive therein by a collar 63. The latching element is of "T" configuration having a flat head 64 of oblong, nearly rectangular, profile (see FIG. 2) to define laterally extending "wings" **64*a*, 64*b* (see also FIGS. 1 and 5**).

For the purpose of interengaging the cover with the head of the latching element, the cover includes a flat-bottomed circular recess 65 having an aperture, or clearance opening, 66 of mating profile and which is laterally bounded by land surfaces 67, 68. At the center of the latching element is a socket 69, preferably hexagonal, for reception of an allen wrench or similar turning tool. A bushing **62*a*** under the head keeps the gap cover in laterally centered condition.

Consequently, when the cover is applied with the head 64 in rotational register with the clearance opening 66 (which is the condition shown in FIGS. 1 and 2), the head passes through the opening 66, following which the head is turned through an angle of 90° from its free position to a locking position in which the wings **64*a*, 64*b* of the head overlie the land surfaces 67, 68**, thereby locking the cover in place.

For the purpose of providing detenting for the latching element, so that the head snaps from its free position to its locking position, and for holding it there until intentionally released upon application of additional turning movement, a detent assembly is employed as set forth in detail in FIGS. 6 and **6*a*. Such detent assembly, indicated at 70, includes a barrel 71 containing a plunger 72, the plunger being biased endwise by a coil spring 73. At the tip of the plunger is a detent 74 which selectively engages flats 75 formed in 90° positions upon the shank of the latching element 61. For adjusting the spring force applied to the plunger, a threaded ferrule 76 is screwed into the barrel 71 to engage the end of the spring. To hold the plunger captive within the barrel the remote end of the plunger is threaded as indicated at 77 and fitted with a nut 78. As a result of the use of the detent assembly, the rotatable latching element tends to snap between 90° positions representing the locked and unlocked states. The detent structure, which forms a part of the assembly 60, is preferably nested in a recess 79 in the bar 30**.

The two fastening assemblies 50, 60 cooperate as follows: Because of the axial orientation of the hook 51 and stirrup 57, the two must be engaged, with endwise movement being applied to the cover to seat the stirrup 57 against the stop 56, before the head 64 of the latching element can be in the condition of register, with the clearance opening 66 (FIG. 2) permitting the head to pass through the opening into the recess 65. It is only then that application of a turning tool, rotating the head 90°, brings the wings **64*a*, 64*b* of the head into locking engagement with the lands 67, 68. That locking has been completed, is apparent upon visual observation (FIG. 5**) and also by the tactile impression, that is, the "feel" on the part of the operator, that the head has indeed moved into a securely detented "crosswise" locking position.

It is one of the features of the present invention that the gap cover 40 is made of highly resilient, that is, springy, material and that the gap cover has, in its unstressed state, a radius of curvature which is substantially less than the installed radius of curvature. Moreover, the fastening assemblies are located at a radius which requires manual pressing of the cover into a slightly flat "sprung" position to effect engagement of the fastening assemblies thereby to achieve a snug fit and to preclude looseness or vibration in the face of accelerational and centrifugal forces as the cylinder rotates.

Figure 2:
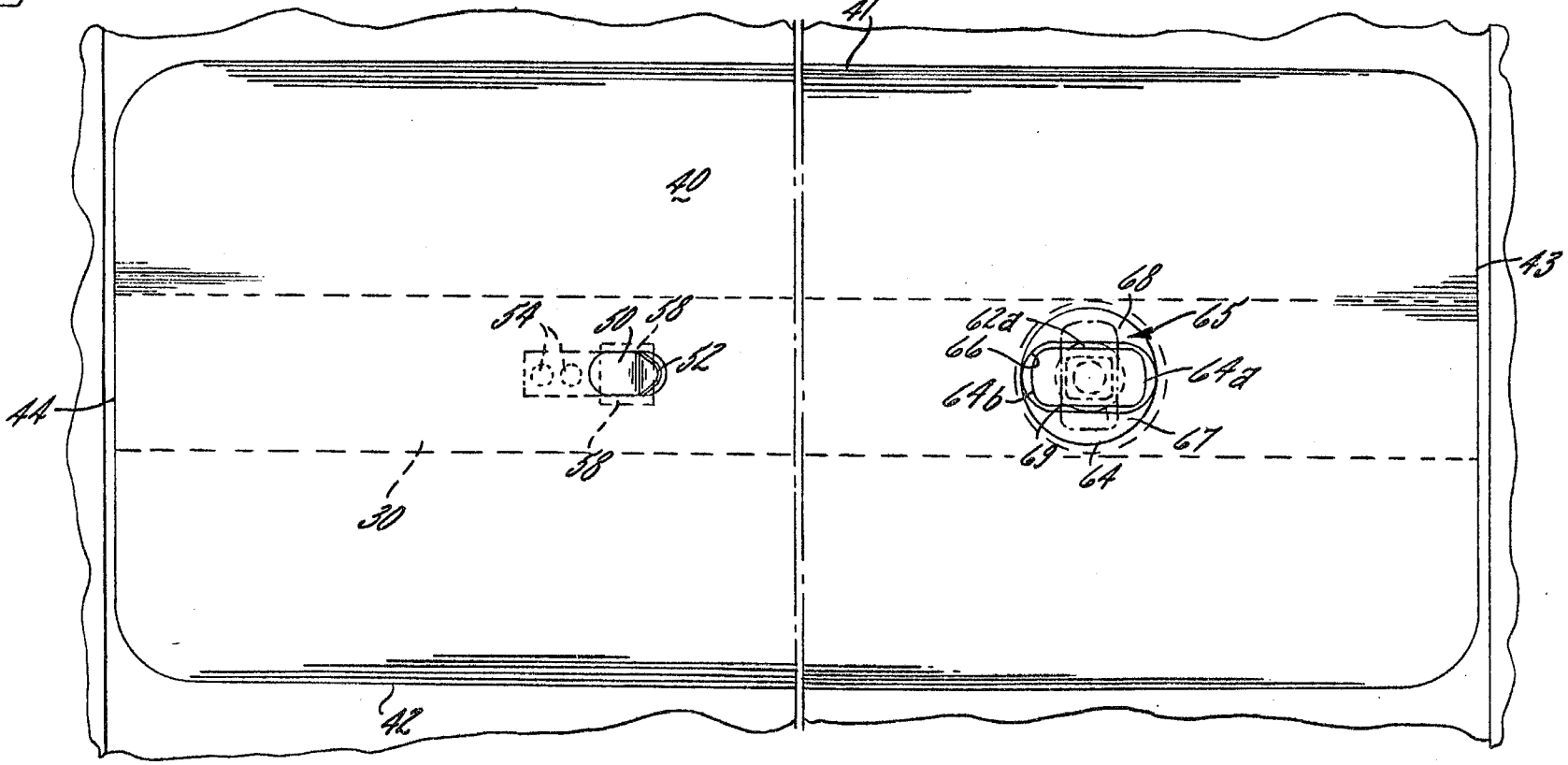
FIG. 2 is a plan view looking along the line 2—2 in FIG. 1.
Figure 4:
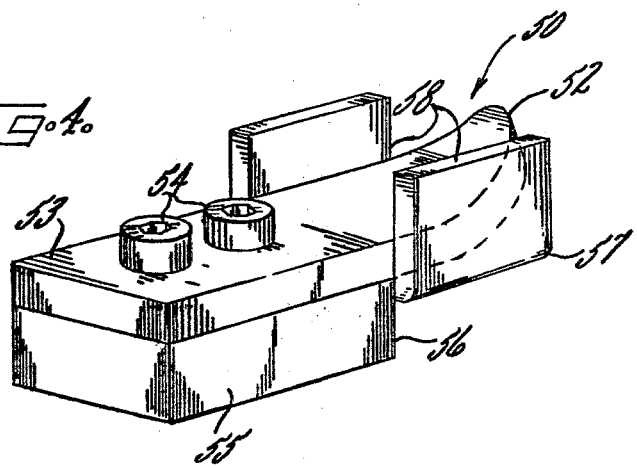
FIG. 4 is a fragmentary perspective showing the first fastening assembly fully engaged.

Turning to FIG. 7, which shows the cover in the unstressed state, it will be noted that the cover has a radius R1 which is less than the installed radius R2 and less than the cylinder radius R3. While the difference has been somewhat exaggerated in FIG. 7 for purposes of clarity, it will be apparent that, in practicing the invention, installation requires manual force F, applied at the center of the cover, to initiate engagement of the tip 52 of the hook with the stirrup 57. Only slight pressure need be applied because the tip of the hook is bent upwardly (FIG. 4) to serve as an inclined plane, camming the corresponding end of the cover downwardly into its sprung position as the stirrup bottoms on the stop 56. This brings the head 64 of the latching element into register with the clearance opening 66 (FIG. 2). Manual pressure is then applied at the opposite end of the plate, also in the direction F, to press the plate inwardly so that the head 64 enters the aperture 65, accompanied by flattening or spreading of the plate into the dot-dash position shown in FIG. 7, following which the head is rotated through 90° by a turning tool into the position shown in FIG. 5 to complete the installation. With the plate in its sprung or slightly flattened condition, a constant force is resiliently exerted by the leading and trailing edges 41, 42 of the cover against the land surfaces on which such edges seat. This makes up for dimensional variations and makes it possible to use the same cover on any one of a number of cylinders equipped with the necessary fastening elements. Indeed, it is possible for a single cover configuration to be used to a universal basis in all of the plate impression and blanket cylinders of a large press. The snug fit precludes vibration or play regardless of the speed at which the cylinder is rotated. Overstressing of the cover by application of the force F is prevented by the fact that the upper surface 31 of the supporting bar 30 acts as a limit stop in the radially inward direction.

Removal of the cover from the cylinder is accomplished quickly and easily by simply reversing the above installation procedure. The head of the latching element is freed by rotating it, with a turning tool, either forwardly or backwardly through the 90° arc of detenting, whereupon the cover, because of its resilience, "pops" upwardly away from the cylinder ready for complete removal by short axial retraction.

While it is preferred to practice the invention by employing two symmetrically arranged wings *64a, 64b* on the head of the rotatable element cooperating with respective lands on the gap cover, it will be apparent that, if desired, one of the wings and one of the lands may be removed without great sacrifice of operating features.

It will be apparent, too, that the gap cover may, if desired, be peripherally somewhat longer than illustrated so that it more nearly seats on the land surfaces 25, 26 of the cylinder; however, it is equally advantageous for the edges of the gap cover to rest on the tautly drawn ends of the flexible printing plate or the tautly drawn ends of the printing blanket or the blanket on the impression cylinder. The term "land surface" is therefore intended to cover both of these possibilities.

In the construction shown, employing an axially oriented hook-and-stirrup, it is preferred to mount the hook on the supporting bar 30 and to form the stirrup as a loop depending from the cover. It will, however, be apparent to one skilled in the art that such relationship may be reversed if desired. Also, while a particular preferred form of detent has been described in detail, the invention may be practiced by the use of any equivalent detenting means providing well defined "free" and "locking" positions for the head 64 with respect to the clearance opening 66 with which it cooperates.

Also, while the invention has been described in connection with a single fastening assembly of the first type 50 and a single fastening assembly of the second type 60, in the case of a particularly long cylinder it is apparent that additional ones of such assemblies might be employed on the same cover, thereby providing more than two points of hold-down.

It will be apparent, finally, to one skilled in the art that the objects of the invention have been amply fulfilled: In the first place the cover and its attaching means is elegantly simple and operated in accordance with a simple operating procedure, making the covers easy to apply and remove and therefore encouraging their usage for safety purposes. Not only does the cover contribute to the safety of the operator, but the security of the attachment insures that the cover will not be lost or thrown clear as a result of press speed and vibration under extensive usage, with the potential damage to the press that such loss could entail. Then too, the construction lends itself to incorporation not only in new press designs but in presses which are already in the field by way of retrofit. Indeed, while the construction has been described in connection with its application to the cylinders of a lithograph press it is not limited to such presses but is usable wherever a gap exists in a rapidly rotating cylinder.

We claim as our invention:

1. In a cylinder of a printing press having a longitudinal channel forming a gap in the cylindrical surface, a gap cover made of a single sheet of thin material formed into accurate cross section to present a surface which is substantially flush with the surface of the cylinder and dimensioned to bridge the gap with its lateral edges extending to lands along the lateral edges of the gap, first and second fastening assemblies accommodated below the presented surface of the cover and axially spaced along the center of the gap, the first assembly including a hook and a registering stirrup for receiving the hook, the hook and stirrup being interposed between the cover and the cylinder to secure the cover in position on the cylinder, the hook being axially oriented so that when the tip of the hook is registeringly engaged and the cover is shifted axially the hook moves relatively into seated position in the stirrup accompanied by shifting movement of the cover into axial register with the cylinder, the second fastening assembly including a latching element having a radially oriented shaft in the cylinder and having at its outer end a flat head of oblong profile forming a pair of wings, means for mounting the latching element so that at least the head thereof is rotatable, the cover having a recessed portion radially aligned with the latching element, the recessed portion containing an aperture of mating oblong profile laterally bounded by land surfaces so that, when the cover is in axial register with the cylinder and the head is in rotational register with the aperture, the head of the latching element may project through the aperture into the recess, means for applying a turning tool to the head to turn the latching element substantially 90 degrees so that the head moves from its rotationally registered free position to a locking position in which the wings of the head overlie the land surfaces thereby locking the cover in place, the shaft of the latching element having an associated detent for snapping the head from its free position to its locking position and for securely holding it there until intentionally released upon application of additional turning movement.

2. In a cylinder of a printing press having a longitudinal channel forming a gap in the cylindrical surface, a gap cover made of a single sheet of thin springy material formed into arcuate cross section and dimensioned to bridge the gap with its lateral edges supportingly engaged by lands along the lateral edges of the gap, first and second fastening assemblies accommodated below the level of the outer surface of the cover and axially spaced along the center of the gap, the first assembly including a hook and a registering stirrup for receiving the hook, the hook and stirrup being interposed between the cover and the cylinder to secure the cover in position on the cylinder, the hook being axially oriented so that when the tip of the hook is registeringly engaged and the cover is shifted axially the hook moves relatively into seated position in the stirrup accompanied by shifting movement of the cover into axial register with the cylinder, the second fastening assembly including a latching element having a radially oriented shaft in the cylinder and having at its outer end a flat head of oblong profile forming at least one wing, means for mounting the latching element so that at least the head thereof is rotatable, the cover having a recessed portion radially aligned with the latching element, the recessed portion containing an aperture of mating oblong profile bounded by at least one land surface so that when the cover is in axial register with the cylinder and the head is in rotational register with the aperture the head of the latching element may project through the aperture into the recess, means for applying a turning tool to the head to turn the latching element substantially 90 degrees so that the head moves from its rotationally registered free position to a locking position in which the head overlies the land surface thereby locking the cover in place, the shaft of the latching element having an associated detent for snapping the head from its free position to its locking position and for securely holding it there until itentionally released upon application of additional turning movement, the cover having a nominal radius of curvature which is smaller than the radius of the cylinder and the fastening assemblies being located at a radius which requires manual pressing of the cover into a slightly fattened sprung position to effect engagement of such fastening assemblies thereby to preclude looseness or vibration in the face of accelerational or centrifugal forces as the cylinder rotates.

3. The combination as claimed in claim 2 in which the latching element is in the shape of a "T", with the wings of the "T" lying in the same axially extending plane.

4. The combination as claimed in claim 1 or claim 2 in which a supporting bar secured to the cylinder extends centrally down the channel in elevated position, the fastening assemblies being anchored to the supporting bar, the bar having a radially presented surface thereon for limiting inward movement of the cover incident to installation thereof in the cylinder.

* * * * *